US006097342A

United States Patent [19]

Engblom

[11] Patent Number: 6,097,342

[45] **Date of Patent: *Aug. 1, 2000**

[54] ANTENNA DEVICE HAVING A MATCHING MEANS

[75] Inventor: Gunnar Engblom, Akersberga, Sweden

[73] Assignee: Allgon AB, Akersberga, Sweden

[ * ] Notice: This patent is subject to a terminal disclaimer.

[21] Appl. No.: 09/314,936

[22] Filed: May 20, 1999

Related U.S. Application Data

[63] Continuation of application No. 08/850,512, May 2, 1997.

[30] Foreign Application Priority Data

May 3, 1996 [SE] Sweden ..... 9601706

[51] Int. Cl.[7] ..... H01Q 1/24

[52] U.S. Cl. ..... 343/702; 343/850; 343/872; 343/895

[58] Field of Search ..... 343/702, 725, 343/749, 852, 850, 860, 872, 873, 900, 895; H01Q 1/24, 1/36

[56] References Cited

U.S. PATENT DOCUMENTS

| | | | |
|---|---|---|---|
| 4,868,576 | 9/1989 | Johnson | 343/895 |
| 5,198,831 | 3/1993 | Burrell et al. | 343/895 |
| 5,212,491 | 5/1993 | Chin et al. | 343/702 |
| 5,300,940 | 4/1994 | Simmons | 343/749 |
| 5,335,368 | 8/1994 | Tamura | 343/702 |
| 5,365,247 | 11/1994 | Veen et al. | 343/702 |
| 5,367,311 | 11/1994 | Egashira et al. | 343/702 |
| 5,594,461 | 1/1997 | O'Neill | 343/895 |

FOREIGN PATENT DOCUMENTS

| | | |
|---|---|---|
| 0718909A2 | 11/1995 | European Pat. Off. . |
| WO94/10720 | 10/1993 | WIPO . |
| WO95/07556 | 3/1995 | WIPO . |
| WO96/37077 | 11/1996 | WIPO . |

OTHER PUBLICATIONS

Diagram of RA3137, Allgon AB Sweden, 1993, (No Month).

*Primary Examiner*—Don Wong
*Assistant Examiner*—Tho Phan
*Attorney, Agent, or Firm*—Jacobson, Price, Holman & Stern, PLLC

[57] ABSTRACT

An antenna device is disclosed, which is intended for a portable radio communication device, in particular a pocket size cellular telephone. The novel antenna device includes a housing (1) having mounting means (2) for mounting on the telephone (3), helically configured first radiator (4) carried by the housing, and an impedance matching means (6) formed by reactive components on a dielectric substrate provided with a printed circuit pattern. The matching means is carried by the housing and it matches an impedance of the first radiator to an impedance of transceiver circuitry of the telephone. The antenna device may include one or more radiators in addition to the first radiator. The disclosed antenna means is particularly advantageous when the antenna device includes at least one radiator of half-wave type.

26 Claims, 2 Drawing Sheets

Fig. 1
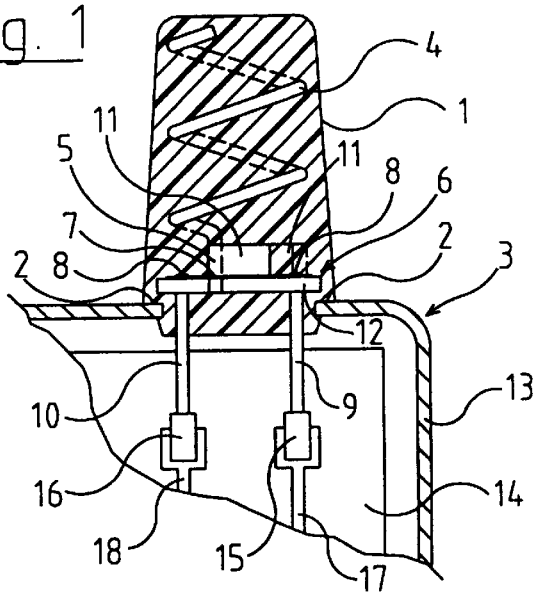
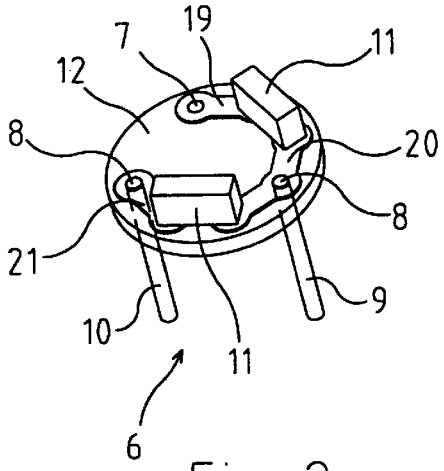
Fig. 2
Fig. 3
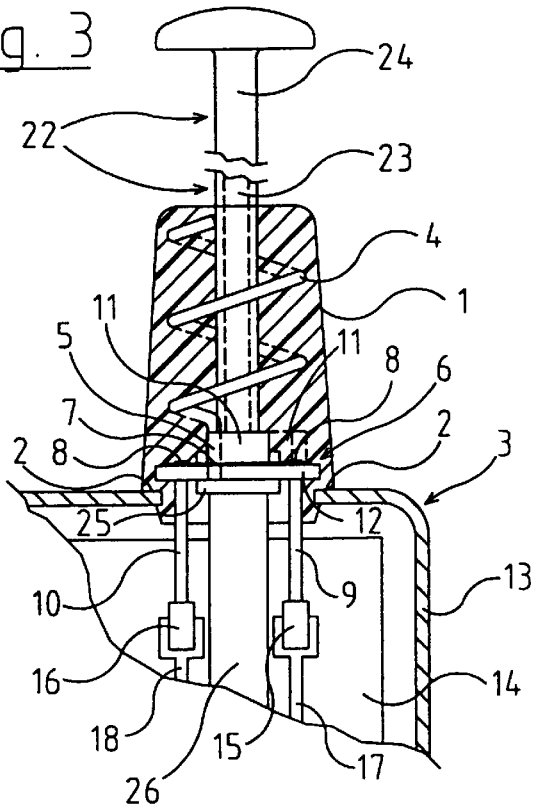
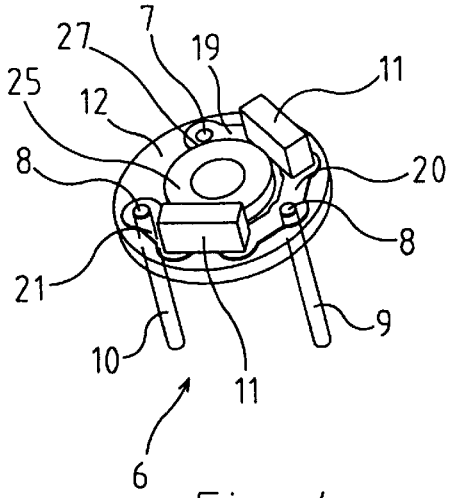
Fig. 4

ANTENNA DEVICE HAVING A MATCHING MEANS

This application is a continuation of Ser. No. 08/850,512 May 2, 1997.

BACKGROUND OF THE INVENTION

1. Field of the Invention

The present invention relates to an antenna device having a carrier structure and a matching means. In particular, the invention concerns an antenna device for a mobile personal telephone. More specifically, the invention is directed towards an antenna device with at least one radiating element having half-wave characteristics.

2. Description of the Related Art

One way of making use of several advantages of the invention, is applying it to an antenna device having a fixed helical radiator in combination with an extendable and retractable straight radiator, at least one being essentially of half-wave type.

In a radio communication device the transmitting/receiving circuits are coupled to the feed point of a radiator means via a feed line. Normally, the transmitting/receiving circuits have a nominal impedance of 50+j0 ohms. If the impedance of the radiator feed point differs substantially from that of the transmitting/receiving circuits, an impedance matching means is required for matching the impedance of the radiator to the impedance of transmitting/receiving circuits.

The radiator and the impedance matching means may then be interconnected by a first feed line or similar having a given length. The first feed line is influenced electromagnetically by different conductive or dielectric bodies in its surroundings, for example, a support on which the radio device is resting, the hand and head of an operator, or the chassis of the radio device or conductive parts thereof. Especially when the radiator feed point impedance is high, the length of the first feed line is significant to the environmental influence on the antenna performance. The higher the impedance of the feed point and the longer the first feed line, the higher the sensitivity to environmental variations.

A radiator of quarter-wave type may not require an impedance matching means to be connected to 50 ohm circuitry. Sometimes, a quarter-wave radiator is preferred since it allows the antenna means to be relatively short and non-obstructive. However, a drawback of quarter-wave radiators, for example in cellular telephones, is that currents are inevitably generated on the chassis of the telephone. The antenna performance is then sensitive to influence by, for example, the operator holding the telephone or pressing it to his ear.

Also, from another point of view, it is desirable to use a radiator with relatively high impedance, for example a half-wave radiator or similar. Generally, a half-wave radiator provides a higher efficiency and a greater overall length resulting in less screening. Particularly, on a small size cellular telephone, screening by the operator's head is a problem with regard to operating range and absorption of radiation in the human body.

An antenna device called RA 3137, designed by Allgon Antenn AB in 1993, includes a housing carrying a straight essentially half-wave radiator, a coaxial connector, and an impedance matching means connecting the radiator and the connector. The impedance matching means consists mainly of a coil located inside a cylindrical ground portion, and interconnecting the radiator feed point and the center pin of the connector. Both the coil and the connector are expensive components in manufacture and assembly. RA 3137 is considered to be the prior art closest to the invention.

U.S. Pat. No. 5,300,940 discloses a similar antenna device for a mobile radio communication device. That antenna device includes a helical or straight radiator and at least one reactive element in the form of, for example, a coil on a core for adapting the radiator impedance and for obtaining a desired bandwidth.

The two above mentioned antenna devices fail to be cost-effective, compact, and provide ease of manufacture in large quantities.

WO 94/10720 discloses an antenna device which comprises a housing carrying a helical radiator and an extendable straight half-wave type radiator, which are connected to an impedance matching means inside a portable telephone. The contents of WO 94/10720 are incorporated herein by reference.

Apparently, problems related to the use of a half-wave type radiator in a mobile radio communication device (a telephone) are: the presence of a high-impedance feed line which is sensitive to disturbance and the need of an impedance matching network which will excessively occupy space inside the telephone or the antenna base.

SUMMARY OF THE INVENTION

One object of the present invention is to provide an antenna device, the first element being substantially directly connected to the impedance matching means, and the impedance matching means being compact.

Other objects of the invention are to provide antenna devices that are suitable for production in large quantities, and that facilitate a design process thereof.

A further advantage of the inventive antenna device is that it enables a well-defined and standardized impedance of the interface of the telephone. This greatly facilitates telephone testing in production and service when the antenna is removed, since test instruments have interfaces of standardized impedance.

The radiating element(s) of the device may be of different types that require impedance transformation for connection to transceiver circuits, but radiating element(s) of half-wave type are preferred. Such antennas are essentially independent of a ground plane.

For mass production it is advantageous that the substrate is a miniature printed circuit board, or a flexible film substrate, having conductive film circuits, possibly also including reactive structures. Further, a circular or annular geometry of the substrate is preferred for ease of mounting in a base of the housing perpendicularly to a direction in which the first element extends. Several other geometries and orientations of the substrate are possible, including an elongated or square form arranged parallel to the first element (possible having some type of edge or edge-mounted connector for contacting the telephone) and even substrates having bends or angles.

The antenna device is advantageously connected to the radio device via a transmission line which is not coaxial in order to avoid complicated and expensive connectors.

In an antenna device for a small-size cellular telephone, it is preferred to have at least one helically configured radiating element. For better performance when required, the helical element may be combined with an essentially straight radiator which is extendable and retractable. The substrate may then carry a contact member for contacting the straight radiator when extended.

In particular, the invention may be advantageously applied when further radiating elements are included in the common housing for operating within a wider frequency band or within two more separated frequency bands. The impedance may need a greater number of reactive components, but it would be possible to provide separate connections to the telephone for separate frequency bands.

BRIEF DESCRIPTION OF THE DRAWINGS

Embodiments of the invention will be described in detail below with references to the drawing, wherein:

FIG. 1 is a partly cross-sectional view of a first embodiment of an antenna device having a helical radiator and an impedance matching network and being mounted on a cellular telephone;

FIG. 2 is a perspective view of the impedance matching network of FIG. 1 in the form of a PCB with reactive components;

FIG. 3 is a partly cross-sectional view of a second embodiment of an antenna device, which differs from that of FIG. 1 mainly in that it further comprises an extendable and retractable antenna whip having a straight radiator in a lower portion;

FIG. 4 is a perspective view of the impedance matching network of FIG. 3, which differs from that of FIG. 2 mainly in that it further comprises a contact member as a part of the network for contacting the straight radiator when the whip is extended;

DETAILED DESCRIPTION OF THE PREFERRED EMBODIMENTS

Figure 6:
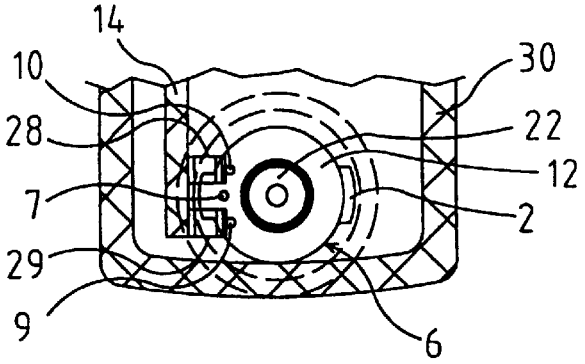
FIG. 6 is a bottom view of the antenna device and the telephone of FIG. 5.

With reference to FIG. 1, the antenna means of a first embodiment comprises an essentially cylindrical antenna housing 1 of a flexible dielectric material which is mounted by snap-in mounting means 2 in an essentially circular opening in a chassis 13 of a cellular telephone 3. The housing 1 carries a helical radiator 4 having a feed point 5 which exhibits a relatively high impedance, e.g. 200 ohms, an impedance matching means 6 formed by a miniature printed circuit board 12 in the shape of a disc located at a lower end of the housing perpendicular to an axis, which is common to the housing and the helical radiator, and having surface-mounted reactive components 11, a first and second connecting means 7, 8 connected to the radiator 4 and, by metal wire segments (first and second conductive members) 9, 10, to transceiver circuits (not shown) of the telephone 3, respectively, the circuits exhibiting a relatively low impedance, e.g. 50 ohms.

The telephone 3 includes a printed circuit board 14 having connecting means 15, 16 for receiving the metal wire segments 9, 10. The connecting means 15, 16 are conventionally used female connectors soldered to circuit board conductors 17, 18 leading to the transceiver circuitry.

With reference to FIG. 2 the printed circuit board 12 of the impedance matching means 6 includes a conductor segment 19 inter-connecting the first connecting means 7 and a first side of a first reactive component 11, a conductor segment 20 inter-connecting the second connecting means 8, 9, a first side of a second reactive component 11, and a second side of the first reactive component 11, a conductor segment 21 inter-connecting the second connecting means 8, 10 and a second side of the second reactive component 11.

This integration of the impedance matching means 6 in the housing 1 requires practically no length of a transmission path having a high impedance between the feed point 5 and the reactive components 11. Thus, influences from the surroundings on such a high-impedance path are minimized. Further, a 50 ohms transmission line, or similar depending on the case, is substantially obtained through the segments 9, 10, the connectors 15, 16, and the printed circuits 17, 18. Alternatively, the connectors 15, 16 on the telephone circuit board 14 may be formed by flexible metal tongues.

With reference to FIG. 3, the antenna means of a second embodiment has all features described above in relation to the first embodiment. Moreover, the second embodiment comprises an antenna whip 22 having a non-conductive upper end portion 24 and an essentially straight radiator 23 included in its lower portion. The antenna whip 22 is carried by the housing 1 so that it is extendable and retractable along a common axis of the housing 1 and the helical radiator 4. The printed circuit board 12 of the impedance matching means 6 is provided with an opening through which the antenna whip 22 is movable.

When the antenna whip 22 is retracted (not shown) it extends into the chassis of the telephone 3 through a non-conductive protective tube 26, which is fastened in the antenna housing 1, and the upper end portion 24 extends inside the full height of the helical radiator 4. In the retracted position, the helical radiator 4 effects practically all the antenna function.

When the antenna whip 22 is extended (shown in FIG. 3) it extends upwards essentially from the impedance matching means 6 through the housing 1 and the helical radiator 4. The straight radiator 23 is then connected to the impedance matching means 6 in parallel with the helical radiator 4 by means of a connecting member 25 at the opening in the circuit board 12. In the extended position, the straight radiator 23 effects the essential part of the antenna function.

With reference to FIG. 4 the printed circuit board 12 of the impedance matching means 6 of the second embodiment includes all features of the impedance matching means of the first embodiment and, in addition thereto, a conductor segment 27 inter-connecting the first connecting means 7, the first side of the first reactive component 11, and the connecting member 25, which makes contact with a lower end of the straight radiator 23 when the antenna whip 22 is in its extended position.

This integration of the impedance matching means 6 in the housing 1 gives the same advantages as those described in relation to the first embodiment. Also, the connectors 15, 16 on the telephone circuit board 14 may alternatively be formed by flexible metal tongues.

Figure 5:
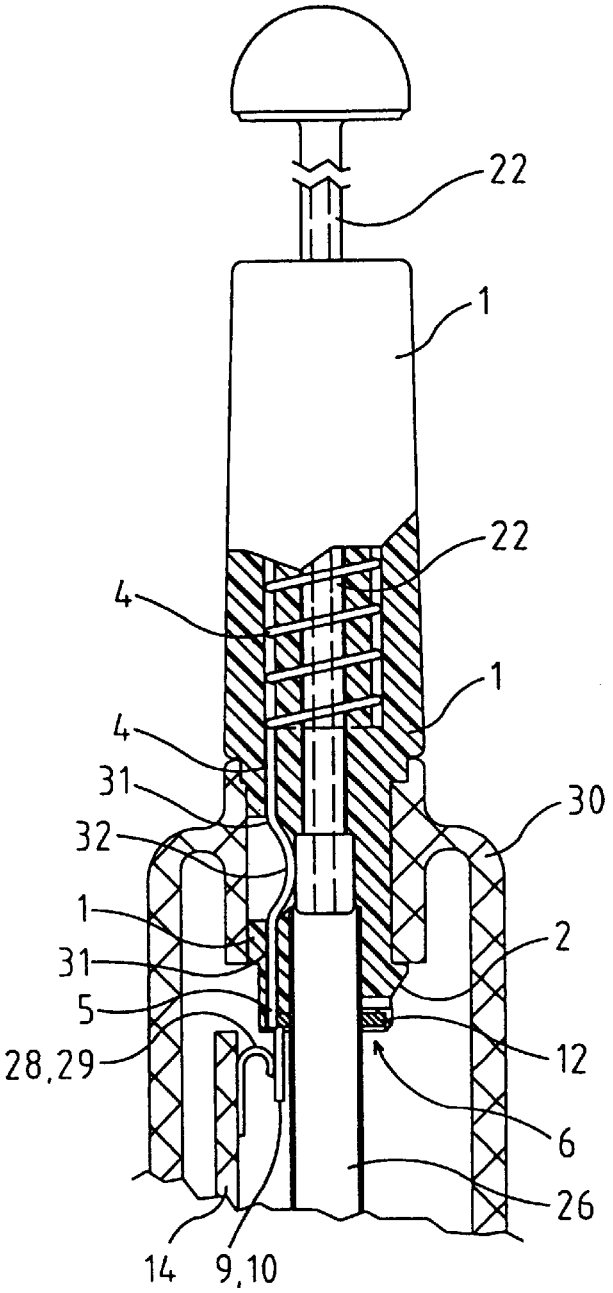
FIG. 5 is a partly cross-sectional view of a third embodiment of an antenna device, which differs from that of FIG. 3 mainly in that its helical radiator begins with a substantially straight portion and that its impedance matching means is located at the bottom of the antenna housing which extends into the telephone chassis.

With reference to FIGS. 5 and 6, the antenna device of a third embodiment includes most features of the second embodiment as shown in FIGS. 3 and 4, with the main exceptions being that the mounting means 2 of the antenna housing is adapted for mounting into a rather high cylindrical opening in the telephone chassis 30, that the impedance matching means 6 is mounted in a slightly conical recess in the lower end of the housing and is enclosed inside the chassis 30 of the telephone (which is however non-conductive), that a lower end portion 31 of the helical radiator leads in an essentially straight configuration from a upper end level of the chassis 30 to the impedance matching means 6 (reactive components thereof not shown), that the lower end portion 31 is provided with a flexible bend 32 departing from the straight configuration and forming, instead of the impedance matching means itself, a contact member for connecting to the a lower portion of the straight radiator when the latter is in its extended position, and that the printed circuit board 14 of the telephone is provided with flexible metal tongues 28, 29 for connection to the antenna means.

Although the invention has been described in relation to specific embodiments, it is to be understood that many more variations are possible without departing from the scope of the invention. Such variations are, for instance, to include in the impedance matching means a switching means that is operated by the extension of the slidable antenna whip, in order to allow radiating elements of different types (half and quarter wave), to arrange the substrate of the impedance matching means in cylindrical or essentially flat configuration in parallel with the antenna housing and radiator axes, and to provide separated circuits in the impedance matching means for two or more conductively separated radiating elements.

Other variations are, for instance, to replace the helical radiator in the aforementioned embodiments with a radiator having meander configuration, as a single meander conductor, or multiple meander conductors, with common or separate feed points. Further variations are, for instance, to replace the helical radiator in the aforementioned embodiments with multiple helical radiator(s).

What is claimed is:

1. An antenna device for a portable radio communication device operating within UHF or adjacent frequency ranges, comprising:

an antenna housing having mounting means for mounting on a radio communication device, a radiating first element carried by the antenna housing, the first element having a first feed point at which it exhibits a first impedance Z1, an impedance matching means being carried by the antenna housing adjacent to the first feed point and having first and second coupling means exhibiting essentially the first impedance Z1 and a second impedance Z2, respectively, the first coupling means being connected to the first feed point, the second coupling means including first and second conductive members being connectable to the radio communication device, the impedance matching means including at least one reactive element connected between the first and second coupling means, the impedance matching means including a dielectric substrate carried by the antenna housing, and being integrated in the antenna housing, the substrate carrying the reactive element(s) and a conductor pattern, which interconnects the reactive element(s) and the first and second coupling means.

2. The antenna device according to claim 1, wherein:

the first element is a half-wave type antenna.

3. The antenna device according to claim 1, wherein:

the substrate is a printed circuit board.

4. The antenna device according to claim 1, wherein:

the substrate is a flexible film carrier having conductive film circuits.

5. The antenna device according to claim 1, wherein:

the substrate has an at least partly circular outer edge for mounting in a corresponding groove or recess in a base of the antenna housing, the substrate is mounted substantially perpendicular to a direction in which the first element extends.

6. The antenna device according to claim 1, wherein:

the first and second conductive members are non-coaxially configured.

7. The antenna device according to claim 1, comprising:

further radiating means for operating within a wider frequency band or within two or more separated frequency bands.

8. The antenna device according to claim 1, wherein:

a further reactive element carried by the substrate is connected between the first and second conductive members.

9. An antenna device for a portable radio communication device operating within UHF or adjacent frequency ranges, comprising:

an antenna housing having mounting means for mounting on a radio communication device, a radiating first element carried by the antenna housing, the first element being helically configured, the first element having a first feed point at which it exhibits a first impedance Z1, an impedance matching means being carried by the antenna housing adjacent to the first feed point and having first and second coupling means exhibiting essentially the first impedance Z1 and a second impedance Z2, respectively, the first coupling means being connected to the first feed point, the second coupling means including first and second conductive members being connectable to the radio communication device, the impedance matching means including at least one reactive element connected between the first and second coupling means, the impedance matching means including a dielectric substrate carried by the antenna housing, and being integrated in the antenna housing, the substrate carrying the reactive element(s) and a conductor pattern, which interconnects the reactive element(s) and the first and second coupling means.

10. The antenna device according to claim 9, comprising:

a radiating second element being an essentially straight radiator which is slidable through the first element along an essentially common axis, the substrate having an annular form to permit the second element to be retracted through it.

11. The antenna device according to claim 10, wherein:

the substrate carries a contact member for contacting the second element when extended.

12. The antenna device according to claim 9, wherein:

the first element is a half-wave type antenna.

13. The antenna device according to claim 9, wherein:

the substrate is a printed circuit board.

14. The antenna device according to claim 9, wherein:

the substrate is a flexible film carrier having conductive film circuits.

15. The antenna device according to claim 9, wherein:

the substrate has an at least partly circular outer edge for mounting in a corresponding groove or recess in a base of the antenna housing, the substrate is mounted substantially perpendicular to a direction in which the first element extends.

16. The antenna device according to claim 9, wherein:

the first and second conductive members are non-coaxially configured.

17. The antenna device according to claim 9, comprising:

further radiating means for operating within a wider frequency band or within two or more separated frequency bands.

18. The antenna device according to claim 9, wherein:

a further reactive element carried by the substrate is connected between the first and second conductive members.

19. An antenna device for a portable radio communication device operating within UHF or adjacent frequency ranges, comprising:

an antenna housing having mounting means for mounting on a radio communication device, a radiating first element carried by the antenna housing, the first element being essentially straight, the first element having a first feed point at which it exhibits a first impedance Z1, an impedance matching means being carried by the antenna housing adjacent to the first feed point and having first and second coupling means exhibiting essentially the first impedance Z1 and a second impedance Z2, respectively, the first coupling means being connected to the first feed point, the second coupling means including first and second conductive members being connectable to the radio communication device, the impedance matching means including at least one reactive element connected between the first and second coupling means, the impedance matching means including a dielectric substrate carried by the antenna housing, and being integrated in the antenna housing, the substrate carrying the reactive element(s) and a conductor pattern, which interconnects the reactive element(s) and the first and second coupling means.

20. The antenna device according to claim 19, wherein:

the first element is a half-wave type antenna.

21. The antenna device according to claim 19, wherein:

the substrate is a printed circuit board.

22. The antenna device according to claim 19, wherein:

the substrate is a flexible film carrier having conductive film circuits.

23. The antenna device according to claim 19, wherein:

the substrate has an at least partly circular outer edge for mounting in a corresponding groove or recess in a base of the antenna housing, the substrate is mounted substantially perpendicular to a direction in which the first element extends.

24. The antenna device according to claim 19, wherein:

the first and second conductive members are non-coaxially configured.

25. The antenna device according to claim 19, comprising:

further radiating means for operating within a wider frequency band or within two or more separated frequency bands.

26. The antenna device according to claim 19, wherein:

a further reactive element carried by the substrate is connected between the first and second conductive members.

* * * * *